US006520166B1

(12) United States Patent
Karau et al.

(10) Patent No.: US 6,520,166 B1
(45) Date of Patent: Feb. 18, 2003

(54) METHOD OF IDENTIFYING ENGINE CYLINDER COMBUSTION SEQUENCE BASED ON COMBUSTION QUALITY

(75) Inventors: Philip Allen Karau, Grand Blanc, MI (US); Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/972,824

(22) Filed: Oct. 5, 2001

(51) Int. Cl.[7] ..... F02P 5/15
(52) U.S. Cl. ..... 123/644
(58) Field of Search ..... 123/644

(56) References Cited

U.S. PATENT DOCUMENTS 4,896,639 A * 1/1990 Holmes ..... 123/406.24
5,337,717 A * 8/1994 Scheel et al. ..... 123/644
5,832,896 A * 11/1998 Phipps ..... 123/352
6,029,631 A * 2/2000 Jiewerdz et al. ..... 123/644
6,032,657 A * 3/2000 Rossi ..... 123/644
6,054,859 A * 4/2000 Takahashi et al. ..... 324/399

* cited by examiner

*Primary Examiner*—Paul J. Hirsch
(74) *Attorney, Agent, or Firm*—Vincent A. Cichosz

(57) ABSTRACT

An improved method of identifying the cylinder combustion sequence of a four-stroke internal combustion engine accepts of rejects an assumed combustion sequence based on measured ion current combustion quality (CQ) indications. Individual CQ indications for the various engine cylinders are algebraically combined as a function of the assumed combustion sequence so that the combined CQ indication increases in a first polarity if the assumed combustion sequence is correct, and in a second polarity if the assumed combustion sequence is incorrect. When the absolute value of the combined CQ indication exceeds a threshold, the polarity of the combined CQ indication is used to either accept or reject the assumed combustion sequence. Each of the measured CQ indications are used without regard to the engine operating condition, and the threshold to which the combined CQ indication is compared is reflective of a confidence level in the assumed combustion sequence, and is not used to distinguish between combustion and exhaust strokes in an individual engine cylinder.

6 Claims, 3 Drawing Sheets

METHOD OF IDENTIFYING ENGINE CYLINDER COMBUSTION SEQUENCE BASED ON COMBUSTION QUALITY

TECHNICAL FIELD

The present invention is directed to a method of identifying the cylinder combustion sequence of a four-stroke spark ignition internal combustion engine, and more particularly to an identification method based on the detected ion current.

BACKGROUND OF THE INVENTION

The ion current across a spark plug gap in an internal combustion engine is sometimes measured as an indication of the combustion strength. Typically, the measured ion current for each engine cylinder is integrated over a predetermined interval to form a combustion quality (CQ) indication that is compared to a threshold. A valid combustion event is verified if the CQ indication is above the threshold, whereas a misfire or non-combustion event is identified if the CQ indication is below the threshold.

One use of the CQ indication in four-stroke engines is to reliably resolve the ambiguity between cylinder stroke and crankshaft position to enable individual cylinder fuel and spark control. During initial engine operation, fuel is distributed to the various engine cylinders on a semi-random basis, and the spark plugs for a pair of opposing engine cylinders (i.e., combustion and exhaust) are fired together, relative to a reference crankshaft position. This initial spark control is commonly referred to as a waste spark mode since the spark discharge in the exhaust cylinder is wasted. If CQ indications above a calibrated threshold are generated in synchronism with an assumed combustion pattern, the assumed combustion pattern is deemed to be correct, and sequential fuel and spark controls are commenced. Otherwise, the assumed cylinder combustion sequence is deemed to be incorrect, and is adjusted by 180° before transitioning to sequential fuel and spark control. See, for example, the Research Disclosure No. 41702, published in January 1999.

While the above-described control can quickly and reliably identify the correct combustion sequence under normal conditions, it has been found that in certain conditions, the CQ indications for both normal combustion and misfire events tend to be lower or higher than under normal conditions. For example, spark plug fouling or the presence of certain fuel additives tends to bias the CQ indications above the normal threshold, even with the incorrect cylinder combustion sequence. On the other hand, the CQ indications sometimes fall below the normal threshold just after engine starting, even with the correct cylinder combustion sequence. As a result, it can take an extended period of time to correctly identify the cylinder combustion sequence, and the reliability of the control is less than desired.

SUMMARY OF THE INVENTION

The present invention is directed to an improved method of identifying the cylinder combustion sequence of a four-stroke internal combustion engine relative to a reference engine position based on measured ion current combustion quality (CQ) indications, wherein an assumed combustion sequence is quickly and reliably accepted or rejected in any engine operating condition. According to the invention, individual CQ indications for the various engine cylinders are not compared to a threshold, but rather, are algebraically combined as a function of the assumed combustion sequence so that the combined CQ indication increases in a first polarity if the assumed combustion sequence is correct, and in a second polarity if the assumed combustion sequence is incorrect. When the absolute value of the combined CQ indication exceeds a threshold, the polarity of the combined CQ indication is used to either accept or reject the assumed combustion sequence. Each of the measured CQ indications are used without regard to the engine operating condition, and the threshold to which the combined CQ indication is compared is reflective of a confidence level in the assumed combustion sequence, and is not used to distinguish between combustion and exhaust strokes in an individual engine cylinder.

In a preferred embodiment, individual CQ indications associated with the assumed combustion strokes increase the combined CQ indication, whereas CQ indications associated with the exhaust strokes decrease the combined CQ indication. Since the exhaust stroke CQ indications are, on average, lower than the combustion stroke CQ indications for any given operating condition, the combined CQ indication will increase if the assumed combustion sequence is correct, and decrease if the assumed combustion sequence is incorrect.

DESCRIPTION OF THE PREFERRED EMBODIMENT

Figure 1:
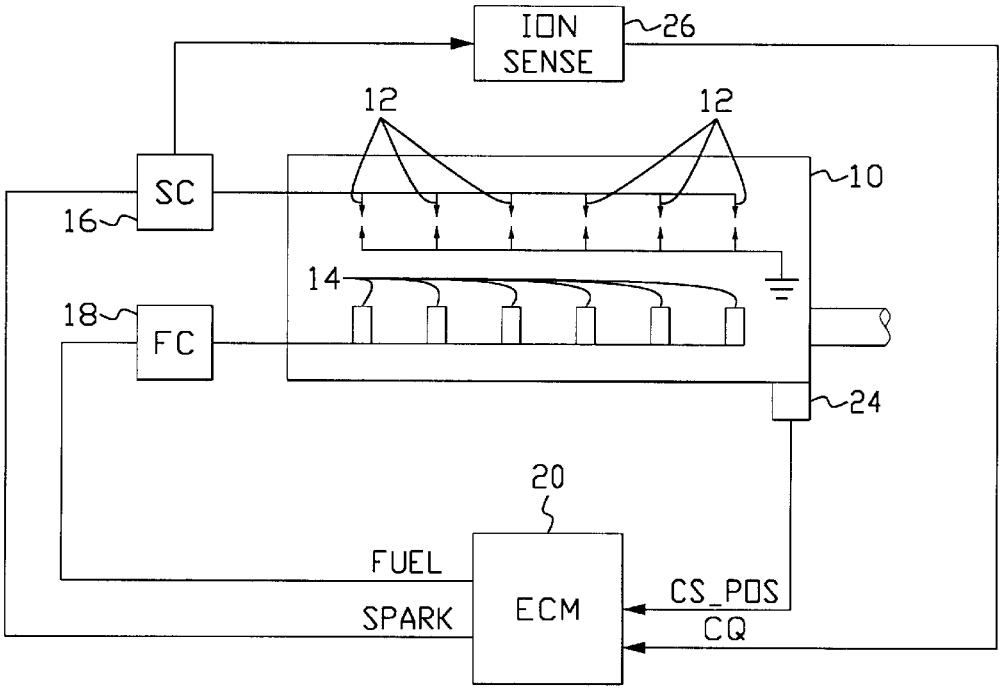
FIG. 1 is a system diagram of a motor vehicle engine control including an ion current sensing ignition module and a microprocessor-based engine control module.

Referring to the drawings, and more particularly to FIG. 1, the reference numeral 10 designates a multi-cylinder four-stroke spark-ignition internal combustion engine controlled according to this invention. In the illustrated embodiment, the engine 10 has six cylinders, each of which is equipped with a spark plug 12 and a fuel injector 14. The spark plugs 12 are individually controlled by a conventional spark control (SC) mechanism 16, and the fuel injectors 14 are individually controlled by a conventional fuel control (FC) mechanism 18, both of which are operated under the control of a conventional microprocessor-based electronic control module (ECM) 20 as indicated. The ECM 20 carries out a number of conventional engine control and diagnostic algorithms, and according to this invention, carries out an additional algorithm for identifying the cylinder combustion sequence for purposes of initiating sequential fuel and spark control. Accordingly, ECM 20 receives a number of engine-related inputs, including a crankshaft position signal CS_POS from a conventional position sensor 24 positioned to detect the passage of gear teeth on a rotary component attached to the crankshaft, such as the engine flywheel. An additional input depicted in FIG. 1 is a combustion quality signal CQ developed by an ion sense module 26. The ion sense circuit module 26 is coupled to the spark control (SC) mechanism 16, and operates in a well known manner to indicate the combustion strength or quality in any given engine cylinder by measuring and integrating the ion current across the gap of a respective spark plug 12 during a combustion event. A more detailed description of an ion current module is given in the U.S. Pat. No. 4,648,367, incorporated herein by reference.

In general, it is desirable for purposes of exhaust gas emission control and fuel economy to carry out both the fuel and spark controls sequentially in synchronism with the engine cylinder combustion events. The combustion events occur in a predetermined order, referred to herein as the firing order, and the crankshaft position sensor 24 is configured to identify a reference position (such as top dead center) of a piston in each cylinder to enable proper timing of the fuel injection and spark discharge. However, the position information is ambiguous because in a four-stroke engine the reference position occurs in both the combustion stroke and the exhaust stroke. In the illustrated embodiment, for example, the reference position occurs at the same time two different engine cylinders (say, cylinder #1 and #4), only one of which is in the combustion stroke of its four-stroke cycle. Once it is known which of the cylinders (that is, cylinder #1 or cylinder #4) is in a combustion stroke, sequential spark and fuel controls can be enabled since the cylinder firing order is known.

As mentioned above, a known control technique is to operate the spark and fuel control mechanisms 16, 18 in a non-sequential mode when the engine is first started, and then to transition to a sequential control mode once the combustion events are unambiguously identified. As indicated above, it is also known that the combustion quality (CQ) indication of an ion sense module may be used to resolve the ambiguity by distinguishing between combustion and non-combustion events; an assumed firing order is confirmed if combustion events occur when predicted, but the assumed firing order is rejected if combustion events occur when non-combustion events are predicted. If the assumed firing order is rejected, it is simply inverted or phase shifted before transitioning to the sequential fuel and spark control modes. See, for example, the Research Disclosure No. 41702, published in January 1999.

A problem with the known control technique described in the preceding paragraph is that under certain conditions, the CQ indications for both combustion and non-combustion events tend to be lower or higher than under normal conditions. For example, spark plug fouling or the presence of certain fuel additives tends to bias the CQ indications above the normal threshold, even with the incorrect cylinder combustion sequence. On the other hand, the CQ indications sometimes fall below the normal threshold just after engine starting, even with the correct cylinder combustion sequence. As a result, it can take an extended period of time to correctly identify the cylinder combustion sequence, and the reliability of the control is less than desired.

In general, the control of this invention overcomes the problems of the known controls by recognizing that the CQ indication of a combustion event for any given engine cylinder is, on average, distinguishable in terms of magnitude from the CQ indication of a non-combustion event, regardless of spark plug fouling, fuel additives, or other unexpected operating conditions. In the illustrated embodiment, for example, the CQ indication is higher, on average, for a combustion event than a non-combustion event, even if various operating conditions bias the CQ indications higher or lower than normal. Thus, if the individual CQ indications are algebraically combined as a function of the assumed combustion sequence, the combined CQ indication will increase in a first polarity if the assumed combustion sequence is correct, and in a second polarity if the assumed combustion sequence is incorrect. In the illustrated embodiment, for example, individual CQ indications associated with the assumed combustion strokes are combined in an additive sense, whereas CQ indications associated with the assumed exhaust strokes are combined in a subtractive sense. As a result, the combined CQ indication will increase if the assumed combustion sequence is correct, and decrease if the assumed combustion sequence is incorrect.

Figure 2:
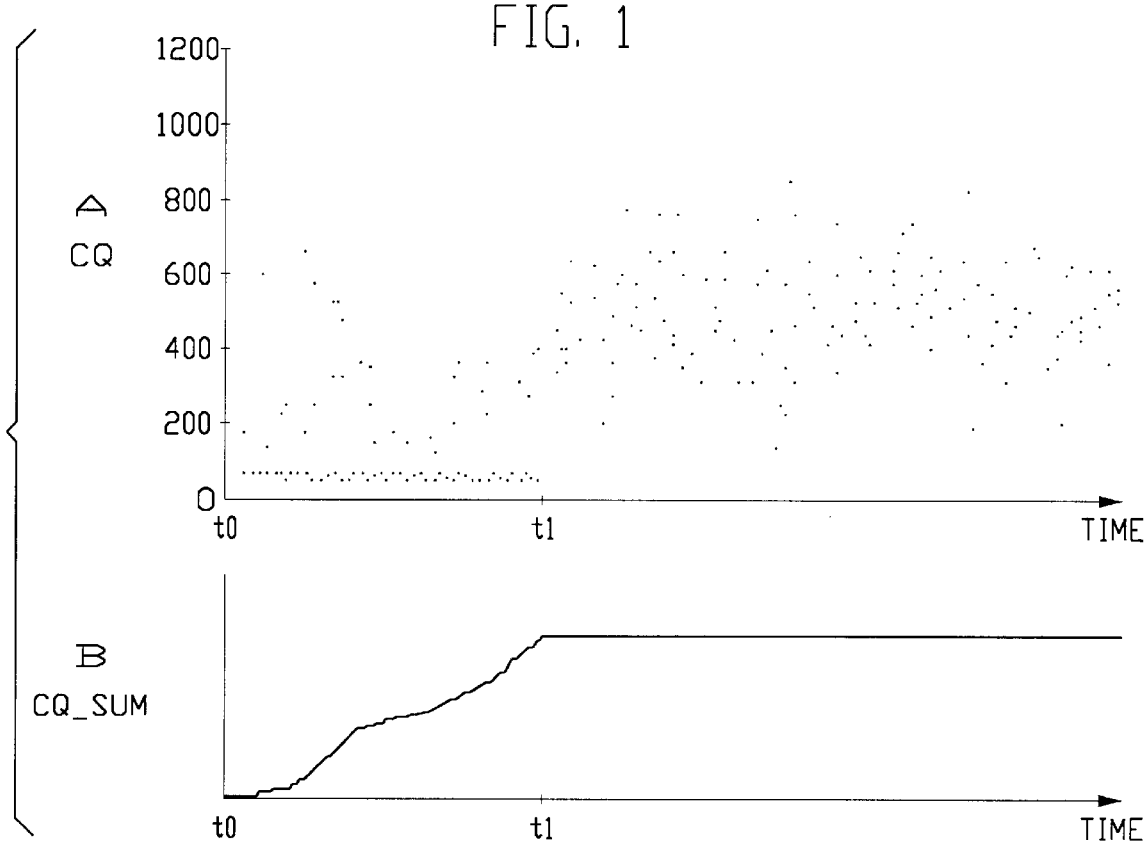
FIG. 2 graphically depicts representative CQ indications developed during engine operation and a combined CQ indication according to a preferred embodiment of this invention.

The above-described control is graphically illustrated in FIG. 2, where Graph A depicts individual CQ indications during an initial period of operation of engine 10 beginning at time t0, and Graph B depicts the combined CQ indication CQ_SUM based on a correct assumption of the cylinder combustion sequence. In general, the CQ data points having a magnitude above about 400 indicate the occurrence of a combustion event whereas the data points below about 400 indicate a non-combustion event. Although it is difficult in many cases to reliably distinguish between a combustion event and a non-combustion event based on an individual CQ indication, the value of CQ_SUM unambiguously increases since the CQ indications for combustion events, on average, exceed the CQ indications for non-combustion events. At time t1, CQ_SUM reaches a threshold THR indicative of a confidence level in the assumed combustion sequence, and the control transitions to sequential spark and fuel controls, whereafter only the CQ indications for known combustion events are depicted in Graph A.

Figure 3:
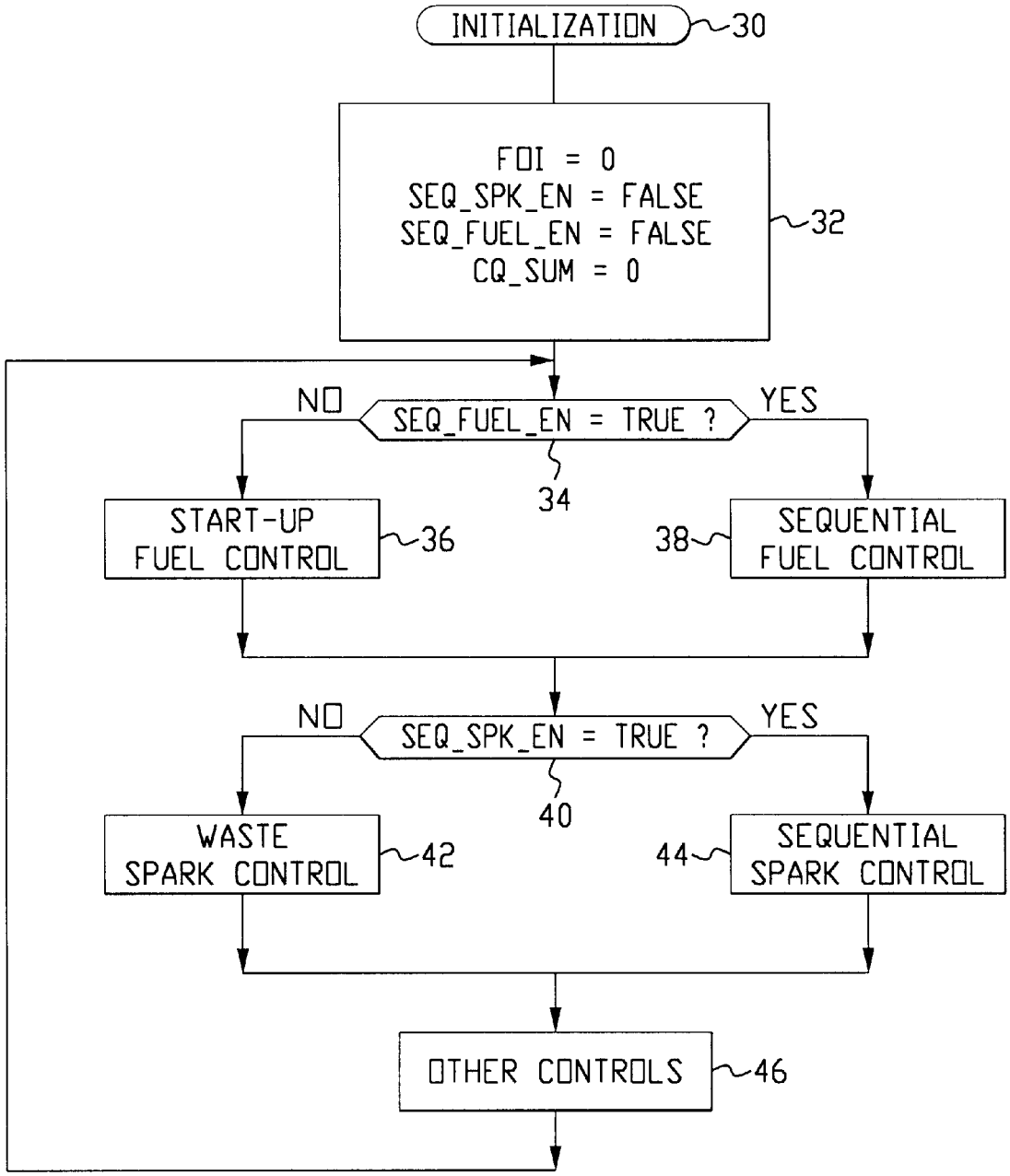
FIGS. 3 and 4 are flow diagrams illustrating the control method of this invention as carried out by the engine control module of FIG. 1.
Figure 4:
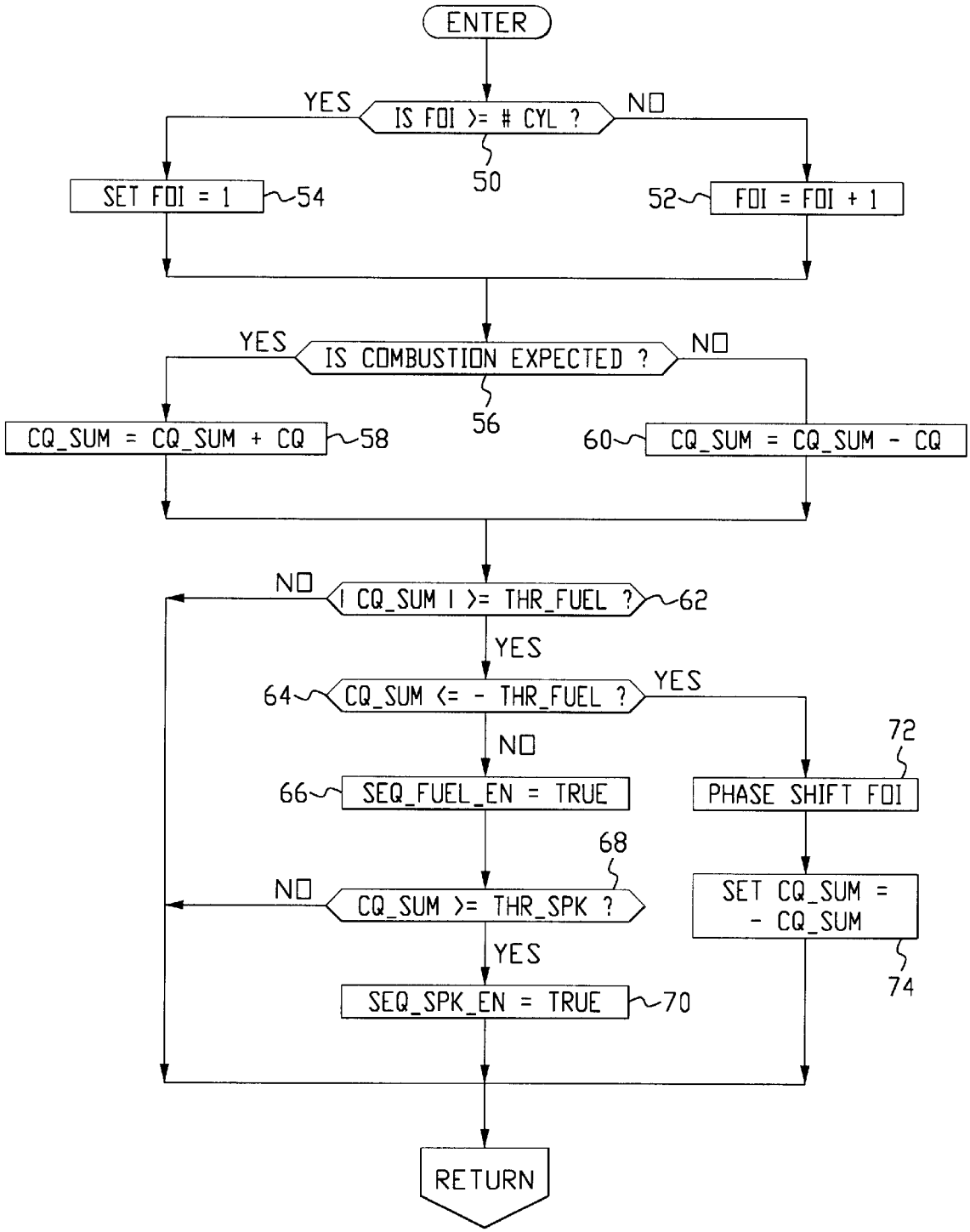

The flow diagrams of FIGS. 3 and 4 are generally representative of computer program instructions executed by ECM 20 in carrying out the control of this invention. The flow diagram of FIG. 3 is a main or executive routine, whereas the flow diagram of FIG. 4 is a routine that is executed each time the crankshaft position signal CS_POS indicates that a cylinder pair is at a reference (such as top dead center) position until sequential fuel and spark controls have been established. The routine of FIG. 4 controls the status of two flags: a sequential fuel enable flag SEQ_FUEL_EN, and a sequential spark enable flag SEQ_SPK_EN. The routine of FIG. 3, in turn, checks the state of the SEQ_FUEL_EN and SEQ_SPK_EN flags to select the appropriate fuel and spark control.

Referring to the main routine of FIG. 3, the block 30 designates a series of initialization instructions executed each time ECM 20 is powered up or setting various flags and variables to a predetermined state. Some initialization instructions pertinent to the control of this invention are depicted in block 32, where for example, the SEQ_FUEL_EN and SEQ_SPK_EN flags are set to a FALSE state, and a filing order index term FOI and CQ_SUM are reset to zero.

Following initialization, the blocks 34–46 are executed repeatedly as indicated by the flow line 48. Block 34 checks the state of the SEQ_FUEL_EN flag, and block 40 checks the state of the SEQ_SPK_EN flag. Initially, both blocks will be answered in the negative due to the above-mentioned initialization instructions, and the blocks 36 and 42 will be executed to carry out a start-up fuel control and a waste spark control. The start-up fuel control may be a default control that distributes sufficient fuel to the intake ports of the various engine cylinders to enable reliable engine starting. The waste spark control fires predetermined pairs of spark plugs instead of individual spark plugs; for example, the spark plugs 12 for cylinders #1 and #4 are fired together based on the crankshaft position CS_POS even though only one of such cylinders is in the combustion stroke. When the state of the SEQ_FUEL_EN flag changes to TRUE, the block 38 is executed to transition to a sequential fuel control in which fuel is injected at the intake port of each cylinder just in advance of its intake stroke; and when the state of the SEQ_SPK_EN flag changes to TRUE, the block 44 is executed to transition to a sequential spark control in which individual spark plugs 12 are fired in accordance with the combustion event sequence. The block 46 simply refers to other control routines and functions performed by ECM 20 prior to re-executing the blocks 34–44.

As indicated above, the routine represented by the flow diagram of FIG. 4 is executed each time the crankshaft position signal CS_POS indicates that a cylinder pair is at a reference position until sequential fuel and spark controls have been established. In general, the routine updates the firing order index, updates CQ_SUM based on the CQ indications produced for the respective cylinder pair, and compares CQ_SUM to a pair of thresholds THR_FUEL and THR_SPK for the fuel and spark controls. Although the control may be carried out with a single threshold THR, as suggested by Graph B of FIG. 2, it is useful in practice to have separate thresholds for fuel and spark controls. In the illustrated embodiment, the fuel threshold THR_FUEL is set lower than the spark threshold THR_SPK; this allows the control to transition to sequential fuel control as early as possible for lowest exhaust gas emissions, while delaying the transition to sequential spark control (which could result in engine stalling) until the confidence in the assumed combustion sequence is very high. Additionally, the thresholds THR_FUEL and THR_SPK may be fixed as illustrated, or variable depending on engine operating conditions.

The firing order index FOI is updated by the blocks 50–54. If the block 50 determines that FOI is less than the total number of engine cylinders (#CYL), block 52 increments FOI to the next cylinder in the firing order. In the illustrated embodiment, this step is a simple one since the firing order of engine 10 is 1-2-3-4-5-6. Also, the position sensor 24 and engine 10 are configured such that the first known crankshaft position always coincides with the reference position of cylinders #1 and #4. Thus, in the first execution of the routine, block 52 increments FOI from zero to one, which represents a guess or assumption that cylinder #1 is the combustion stroke cylinder and that cylinder #4 is the exhaust stroke cylinder. After FOI has been incremented to six in this manner, block 54 resets FOI to one to reset the assumed combustion sequence.

The blocks 56–60 combine the CQ indications received from ion sense module 26 to form CQ_SUM. The block 56 determines if combustion is expected based on FOI. If combustion is expected, the CQ indication is added to CQ_SUM at block 58; if combustion is not expected, the CQ indication is subtracted from CQ_SUM at block 60. In the illustrated embodiment, the reference positions of cylinders #1 and #4 coincide (as do cylinders #2 & #5, and cylinders #3 & #6), and FOI=1; this indicates an assumption that cylinder #1 is the combustion stroke cylinder and that cylinder #4 is the exhaust stroke cylinder, as mentioned above. Thus, CQ_SUM is increased by the CQ indication for cylinder #1, and decreased by the CQ indication for cylinder #4. If the assumption is correct, the CQ indication obtained for cylinder #1 will be higher than for cylinder #4, resulting in a net increase in CQ_SUM. In the next execution of the routine, this same process is repeated for cylinders #2 and #5, with the assumption (FOI=2) that cylinder #2 is the combustion stroke cylinder, and that cylinder #5 is the exhaust stroke cylinder, and so on. If the assumed combustion sequence is correct, the net adjustment of CQ_SUM for each cylinder pair will increase CQ_SUM as shown in Graph B of FIG. 2; if the assumed combustion sequence is incorrect, the net adjustment of CQ_SUM for each cylinder pair will decrease CQ_SUM.

The block 62 compares the absolute value of CQ_SUM to a confidence threshold THR_FUEL for sequential fuel control enable. If |CQ_SUM| is less than THR_FUEL, the remainder of the routine is skipped; if |CQ_SUM| is at least as great as THR_FUEL, block 64 determines if the sign of CQ_SUM is negative. If CQ_SUM is positive and greater than THR_FUEL, the assumed combustion sequence is deemed to be correct, and block 66 is executed to set the SEQ_FUEL_EN flag to TRUE, enabling sequential fuel control as described above. However, if block 64 determines that CQ_SUM is negative, the assumed combustion sequence is deemed to be incorrect, and blocks 72–74 are executed to phase shift the assumed combustion sequence by 180° and to reverse the sign of CQ_SUM. Phase shifting the assumed combustion sequence in the illustrated embodiment merely involves incrementing FOI three times, with a roll-over check similar to blocks 50 and 54 described above. Reversing the sign of CQ_SUM maintains the accumulated CQ indications, allowing CQ_SUM to reach the respective thresholds THR_FUEL and THR_SPK in roughly the same amount of time that would have elapsed if the assumed combustion sequence had been correct. In the next execution of the routine, block 64 will be answered in the negative, and block 66 will set the SEQ_FUEL_EN flag to TRUE as described above. The block 68 compares CQ_SUM to the confidence threshold THR_SPK for sequential spark control enable. As soon as CQ_SUM reaches THR_SPK, the block 70 sets the SEQ_SPK_EN flag to TRUE, enabling sequential spark control as described above.

In summary, the control of the present invention provides a simple and reliable method of using ion sense combustion quality indications to quickly identify the correct cylinder combustion sequence in a four-stroke internal combustion engine. While described in reference to the illustrated embodiments, it is expected that various modifications in addition to those mentioned above will occur to those skilled in the art. Thus, it will be understood that methods incorporating these and other modifications may fall within the scope of this invention, which is defined by the appended claims.

What is claimed is:

1. A method of identifying a cylinder combustion sequence of a four-stroke multi-cylinder internal combustion engine including a spark ignition system that develops a combustion quality indication based on ion current flow for each spark plug firing, the method comprising the steps of:

concurrently firing spark plugs for first and second engine cylinders when one of such cylinders is in a combustion stroke and the other of such cylinders is in a non-combustion stroke;

algebraically combining combustion quality indications for the spark plugs for said first and second engine cylinders based on an assumed sequence of cylinder combustion events relative to a reference engine position to form a combined combustion quality indication that changes in a first polarity if the assumed sequence is correct, and in a second polarity if the assumed sequence is incorrect; and when a magnitude of the combined combustion quality indication reaches a threshold:

accepting the assumed sequence as correct if the combined combustion quality indication has said first polarity, and rejecting the assumed sequence as incorrect if the combined combustion quality indication has said second polarity.

2. The method of claim 1, wherein a magnitude of the combustion quality index for a combustion stroke is distinguishable, on average, from that of a non-combustion stroke, and wherein CQ indications associated with assumed combustion strokes adjust the combined CQ indication in accordance with said first polarity, and CQ indications associated with assumed non-combustion strokes adjust the combined CQ indication in accordance with said second polarity.

3. The method of claim 1, wherein the step of rejecting the assumed sequence includes the steps of:

phase shifting the assumed sequence of cylinder combustion events by one-half the number of engine cylinders; and changing a polarity of the combined combustion quality indication.

4. The method of claim 1, wherein said engine has fuel and spark controls, and the method includes the steps of:

enabling the fuel control to perform an individual cylinder fuel control when said combined combustion quality indication reaches a first threshold; and enabling the spark control to perform an individual cylinder spark control when said combined combustion quality indication reaches a second threshold that is higher than said first threshold.

5. The method of claim 4, including the steps of:

accepting the assumed sequence of cylinder combustion events as correct if the combined combustion quality indication has said first polarity when a magnitude of the combined combustion quality indication reaches said first threshold; and rejecting the assumed sequence of cylinder combustion events as incorrect if the combined combustion quality indication has said second polarity when the magnitude of the combined combustion quality indication reaches said first threshold.

6. The method of claim 5, wherein the step of rejecting the assumed sequence of cylinder combustion events includes the steps of:

phase shifting the assumed sequence of combustion events by one-half the number of engine cylinders;

changing a polarity of the combined combustion quality indication;

enabling the fuel control to perform an individual cylinder fuel control; and repeating the step of algebraically combining combustion quality indications until the combined combustion quality indication reaches said second threshold.

* * * * *